US007901530B2

(12) United States Patent
Aldrich

(10) Patent No.: US 7,901,530 B2
(45) Date of Patent: Mar. 8, 2011

(54) FABRIC SEAMS

(75) Inventor: William D. Aldrich, Wilson, NC (US)

(73) Assignee: Voith Fabrics Patent GmbH, Heidenheim (DE)

( * ) Notice: Subject to any disclaimer, the term of this patent is extended or adjusted under 35 U.S.C. 154(b) by 0 days.

(21) Appl. No.: 12/337,109

(22) Filed: Dec. 17, 2008

(65) Prior Publication Data

US 2009/0151861 A1 Jun. 18, 2009

Related U.S. Application Data

(62) Division of application No. 10/472,610, filed as application No. PCT/EP02/03114 on Mar. 20, 2002, now abandoned.

(30) Foreign Application Priority Data

Mar. 22, 2001 (GB) ..... 0107195.0

(51) Int. Cl.

| | |
|---|---|
| ***B29C 65/00*** | (2006.01) |
| ***B29C 65/02*** | (2006.01) |
| ***D03D 25/00*** | (2006.01) |
| ***D04H 13/00*** | (2006.01) |

(52) U.S. Cl. ..... 156/148; 139/383; 139/383 A; 156/60; 156/91; 156/393; 162/232; 162/289; 428/38; 428/53; 428/57; 428/189; 428/222

(58) Field of Classification Search ..... 428/57, 428/38, 53, 189, 222, 148; 156/148, 60, 156/91, 393; 139/383, 383 A; 162/232, 162/289

See application file for complete search history.

(56) References Cited

U.S. PATENT DOCUMENTS

| | | | |
|---|---|---|---|
| 4,467,839 | A | 8/1984 | Westhead |
| 4,500,590 | A | 2/1985 | Smith |
| 4,632,716 | A | 12/1986 | Smith |

(Continued)

FOREIGN PATENT DOCUMENTS

| | | |
|---|---|---|
| EP | 0341042 | 11/1989 |
| WO | 9211412 | 7/1992 |
| WO | 0012813 | 3/2000 |

OTHER PUBLICATIONS

International Search Report for PCT/EP02/03114.

(Continued)

*Primary Examiner* — David R Sample
*Assistant Examiner* — Brent T O'Hern
(74) *Attorney, Agent, or Firm* — Taylor IP

(57) ABSTRACT

A method of manufacturing a fabric seam in a fabric for use as papermachine clothing, the fabric having loops at each of the fabric's transverse ends adapted for interconnection by way of a pintle to make the fabric endless, including the steps of bringing the ends into end-to-end disposition in order to interdigitate the loops, inserting a pintle in the interdigitated loops, heat setting to fix base yarns and the loops of the fabric in place, inserting at least one stuffer yarn, at least a part of which includes a low melt component, into selected void areas in the loops adjacent the pintle, adhering at least one batt layer to the seam by needling, and further heat setting to at least partially melt the stuffer yarn such that it deforms to substantially take on the shape of the void areas at the pintle joint, to bind fibers of the batt needled into the void areas and to bind adjacent yarns of the fabric.

3 Claims, 4 Drawing Sheets

U.S. PATENT DOCUMENTS

| | | | |
|---|---|---|---|
| 4,791,708 | A | 12/1988 | Smolens |
| 4,883,096 | A | 11/1989 | Penven |
| 5,053,109 | A | 10/1991 | Penven |
| 5,657,797 | A | 8/1997 | Townley et al. |

OTHER PUBLICATIONS

McGraw-Hill Dictionary of Scientific and Technical Terms, Fifth Edition, copyright 1994, p. 595.

The Merriam-Webster Dictionary, copyright 1997, p. 394.

FABRIC SEAMS

CROSS REFERENCE TO RELATED APPLICATIONS

This is a divisional application of U.S. patent application Ser. No. 10/472,610, entitled "FABRIC SEAMS", filed May 7, 2004, now abandoned which is incorporated herein by reference. U.S. patent application Ser. No. 10/472,610 is the U.S. National Stage entry of PCT application no. PCT/EP02/03114, entitled "IMPROVEMENTS IN FABRIC SEAMS", filed Mar. 20, 2002, which is incorporated herein by reference. PCT application No. PCT/EP02/03114 claims priority to GB 0107195.0 filed on Mar. 22, 2001, which is incorporated herein by reference.

BACKGROUND OF THE INVENTION

1. Field of the Invention

The present invention relates to improvements in fabric seams, and in particular, but not exclusively to, fabric seams used in the jointing of papermachine clothing.

2. Description of the Related Art

A woven fabric for seamed papermachine clothing generally has the warp yarns at its respective transverse end faces woven back into the fabric to form loops at each of the respective fabric ends, the ends are then placed in end-to-end disposition in order to interdigitate the loops and a pintle wire is then inserted in the interdigitated loops to lock the ends together to bring the fabric into an endless form.

The region of the seam has a larger void area than the rest of the fabric, resulting in a differential dewatering in this area which may lead to marking of the paper web. Also, if the fabric is used as a base fabric in a press felt, a batt layer is needled to the base fabric, this batt being less well anchored to the fabric in the region of the seam. The void area in the region of the seam results also in a higher air permeability, which means that on passing a dewatering suction box this seam area may become more sucked therein than the rest of the fabric, thereby increasing wear in the seam region and further reducing the adherence of the batt to the base cloth. The void area will also compress more when the fabric goes through a press nip, the difference in compressibility increasing the incidence of marking of the paper web. The void areas will also allow more water flow in the press nip resulting in a hydraulic mark in the paper web.

In order to mitigate this, various methods have been tried in order to improve the wear resistance of the seam by applying scrims and adhesive treatments. However, it has been found that such treatments reduce the permeability of the belt in the region of the seam and this can lead to undesired marking of the paper web as a result of the differential dewatering in the region of the seam. Also, the treatment can add to belt stiffness. Increased stiffness and difference in permeability can each cause press bounce and render the belt more prone to filling. Also, the major problem with these methods is that of being able to locate the scrim or adhesive with precision.

Another approach to solving this problem is described in International Patent Application No. WO 92/11412 (Nordiskafilt AB) in which a multi filament yarn is woven, during the weaving of the papermachine clothing, in the loop yarns in a plain weave in order to strengthen the seam and reduce the differential permeability in the seam region. The structure formed is then exposed to a heat treatment in order to finish the papermachine clothing. The drawback to this approach is that it impedes installation of the connecting pintle wire, since the multifilament yarn is woven inside the part of the loop through which the pintle is inserted. Also, the heat setting finishing treatment precludes the use of weaving the loops with a low melt multifilament yarn, since such a yarn would melt during the heat setting process. Sewing the yarn in after heat setting is so time consuming that it makes it uneconomical to do so.

What is needed in the art is to retard the rate of seam wear and to provide more homogeneity with respect to hydraulic pressure in the seam region when compared to that of the remaining fabric.

SUMMARY OF THE INVENTION

The present invention provides, in accordance with a first aspect of the present invention, a method of manufacturing a fabric seam in a fabric for use as papermachine clothing, the fabric having loops at each of the fabric's transverse ends adapted for interconnection by way of a pintle to make said fabric endless, including the steps of bringing the said ends into end-to-end disposition in order to interdigitate the loops, inserting a pintle in the interdigitated loops, heat setting to fix base yarns and the loops of the fabric in place, inserting at least one stuffer yarn at least a part of which includes a low melt component into selected void areas in the loops adjacent said pintle, adhering at least one batt layer to the seam by needling, and further heat setting to at least partially melt said stuffer yarn such that it deforms to substantially take on the shape of said void areas at the pintle joint, to bind fibers of the batt needled into the void areas and to bind adjacent yarns of the fabric.

By subsequently inserting and then melting the stuffer yarn, the stuffer material is able to flow into or deform to substantially take on the shape of the void areas, including the undulations between the interdigitized loops and thereby improve the homogeneity of the fabric allowing a more even dewatering, reduction in bounce with consequential improved resistance to marking. Furthermore any fibers from the batt needled into the stuffer yarn will be encapsulated therein, thereby improving the anchoring of the batt to the fabric in the seam region with subsequent reduction in wear to the batt and hence reduction in possible marking of paper transported thereon. By selecting the mass and melt characteristics of the stuffer yarn, the permeability and compression properties of the yarn in the seam region can be controlled and adapted to more closely match that of the remaining fabric. The yarn size selection is based on the size of the hole that is receiving the stuffer yarn, which is dependant on the diameter of the warp and weft yarns.

Preferably, said low melt component of the stuffer yarn is selected to have a melting point which is less than that of the fabric. This has the advantage that the step of further melting can be conducted at a temperature below the melting point of the fabric, thereby further melting and deformation of the fabric does not occur when the stuffer yarn is melted to take on the shape of the void areas.

The fabric may be woven and the loops formed by the back weaving of free warp yarns, or the loops may be separate seaming spirals which are bound into the fabric by a holding yarn.

In accordance with a second aspect of the present invention there is provided a fabric seam in a fabric for use as papermachine clothing, which fabric has loops at each of the fabric's transverse ends which have been interdigitated and connected by a pintle to form a seam and to thereby make the fabric endless, the seam further including at least one stuffer yarn at least a part of which includes a low melt component.

Preferably, the melting point of the low melt component of the stuffer yarn is less than that of the fabric.

The fabric in which the seam is formed may include at least one batt needled to the fabric, wherein at least some of the fibers of the needled batt are bound by the stuffer yarn.

In a preferred embodiment the stuffer yarn has a denier of 1600, more preferably the melting point of the low melt component is up to 140° C.

Investigations have revealed that the use of a stuffer yarn having low melt component significantly improves ease of seaming. The needled batt fibers are held in place by the melted and reformed or deformed stuffer yarns in a shape conforming to the shape of the opposite side's loops, even when the seam is opened up prior to installation.

This preserves an open channel to facilitate pintle insertion. The melted stuffer yarn/fiber mass packs tightly to the base of each loop, which holds the base of each loop firmly in place and dramatically increases the loop bending stiffness.

In accordance with a third aspect of the present invention there is provided a stuffer yarn for use in the manufacture of a fabric seam in a fabric for use as papermachine clothing, the stuffer yarn including a low melt component which has a melting point which is less than that of the fabric into which the yarn is to be inserted.

The stuffer yarn could be in the form of a monofilament yarn including 100% low melt material, or alternatively may be in the form of a bi-component yarn in which the sheath forms the low melt component.

The stuffer yarn could alternatively include multi-filaments at least some of which form the low melt component and may include at least some bi-component filaments in which the sheath forms the low melt component.

The stuffer yarn could be a spun yarn and may include bi-component staple fibers with the sheath thereof forming the low melt component. The spun yarn may alternatively include or additionally include staple fibers at least some of which include the low melt component.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
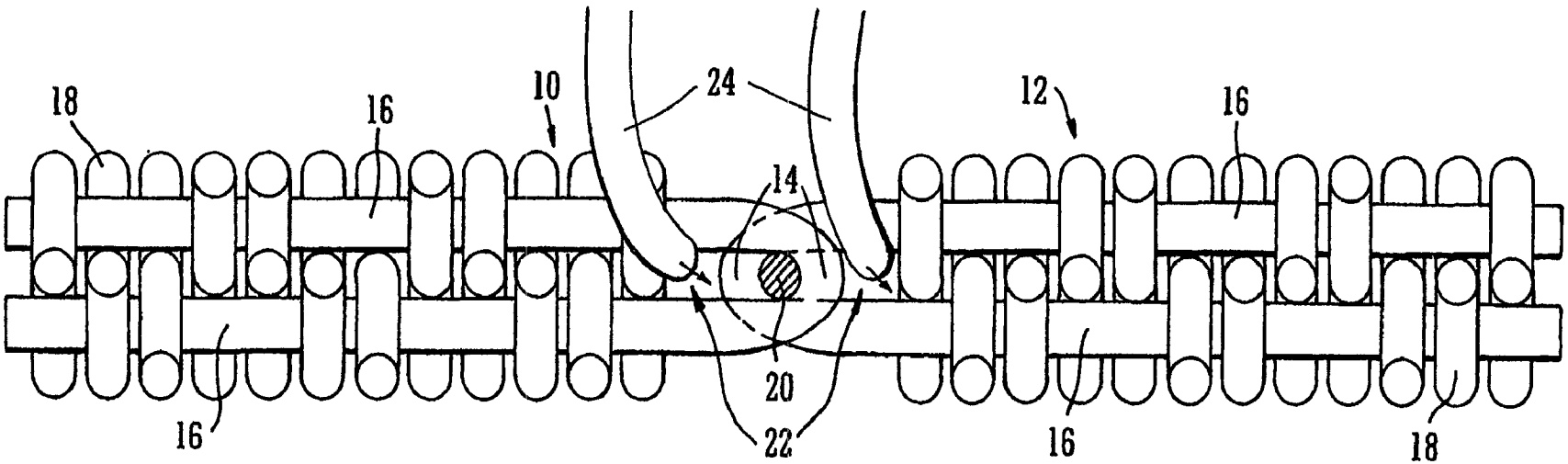
FIG. 1 is a diagrammatic cross-sectional view, illustrating a seam constructed in accordance with one embodiment of the present invention and before insertion of low melt stuffer yarns.
Figure 2:
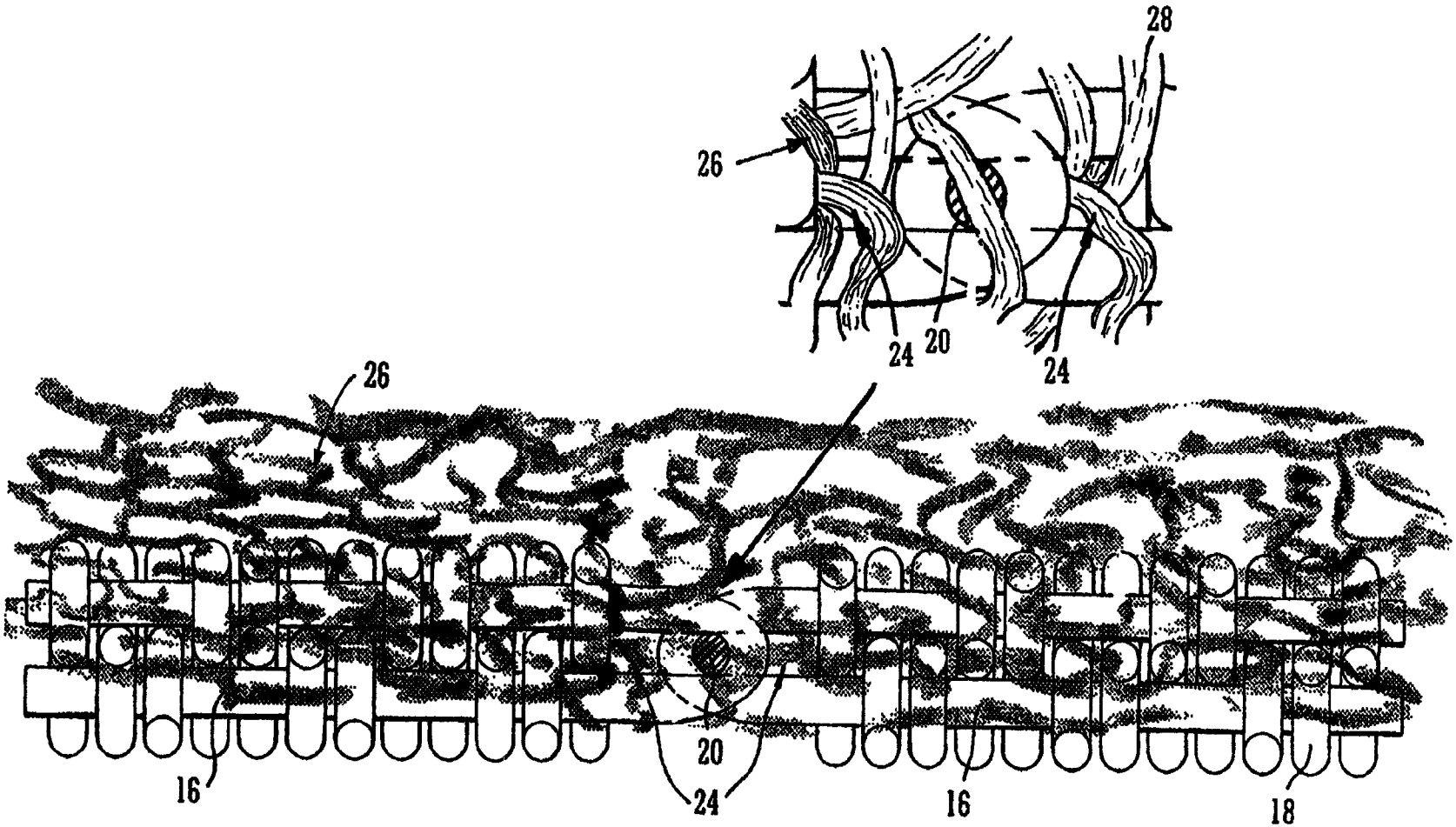
FIG. 2 is a view similar to FIG. 1 wherein the seam is fully formed in that low melt stuffer yarns have been inserted, a batt layer has been attached by needling and subsequently the low melt stuffer yarn has been melted.

Referring now to the drawings, and more particularly to FIGS. 1 and 2, there is shown the structure which includes a fabric including a base layer the ends 10, 12 of which are joined by seaming loops 14 formed by yarns 16 extending in the machine direction (MD). The cross machine (CD) yarns are represented by numeral 18. The seaming loops 14 are interdigitated as usual, and a relatively thick yarn 20 is inserted to provide a pintle wire for joining the fabric ends 10, 12. The fabric is then heat set to fix the shape of the loops and the yarns of the base layer. Gaps between the ends of the loops 14 and the main body of CD yarns 18 are represented by numeral 22.

A low melt 'stuffer' yarn 24 having a denier of 1600 and a melting point of less than 140° C., is then inserted into each of the gaps 22. The stuffer yarn 24 is distanced from pintle 20 by the interdigitated loops 14 connected by pintle 20. A batt layer 26 is attached by needling and the fabric is then heated to a temperature sufficiently high so as to melt the low melt stuffer yarns 24 but not the MD and CD yarns 16, 18 or batt 26. This causes the low melt stuffer yarns 24 to melt and to encapsulate, upon cooling, any fibers 28 of the batt layer that have been needled into the low melt stuffer yarn 24 during the needling process. The seam is then cut open in the usual manner.

Figure 3:
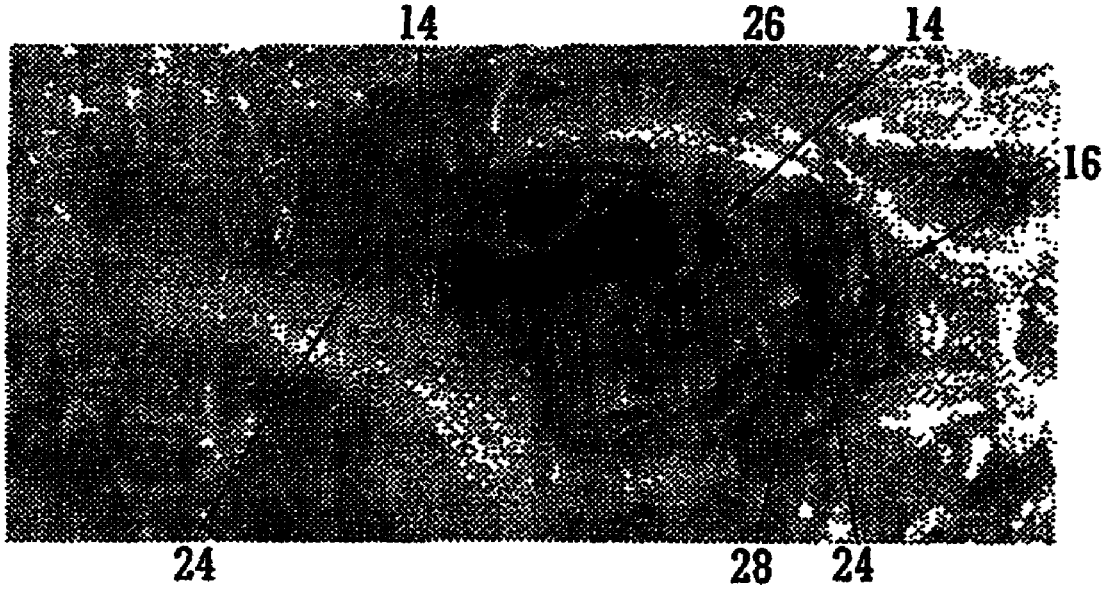
FIG. 3 is a video microscope picture showing the completed seam of FIG. 2 but after removal of the pintle wire.

FIG. 3 is a photograph of the seam constructed as described above but with the pintle 20 removed and in which the entrapment of individual fibers 28 of the batt 26 is illustrated together with the filling of the gaps 22 by the cooled stuffer 24.

In order to place the fabric on a papermaking machine, the pintle wire may be removed and the fabric opened and entwined about the rollers. The fabric is once again made endless by re-interdigitating the loops and inserting a fresh pintle wire. The heat setting of the loops and base yarns together with that of the low melt stuffer yarn preserves an open channel which facilitates easy re-insertion of the pintle. Furthermore the low melt stuffer improves the homogeneity of the seam region.

Figure 4:
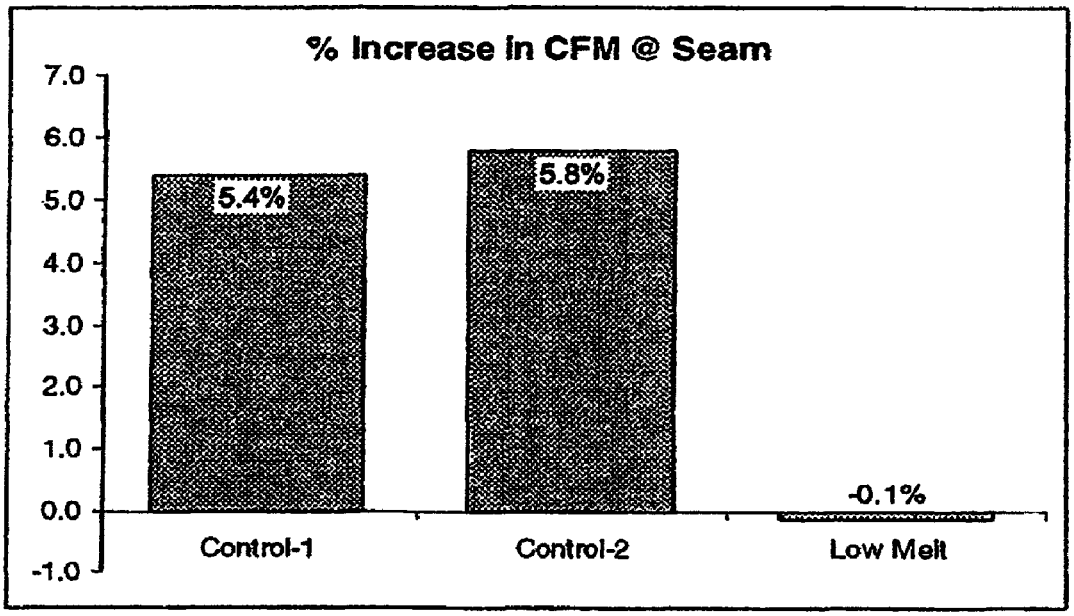
FIG. 4 is a bar chart illustrating percentage increase in permeability in the region of the seam compared to the non-seam region of the fabric, for three fabric seams of the same construction with the exception that one of the fabrics additionally includes the low melt stuffer yarns as per the structure of FIG. 2.
Figure 5:
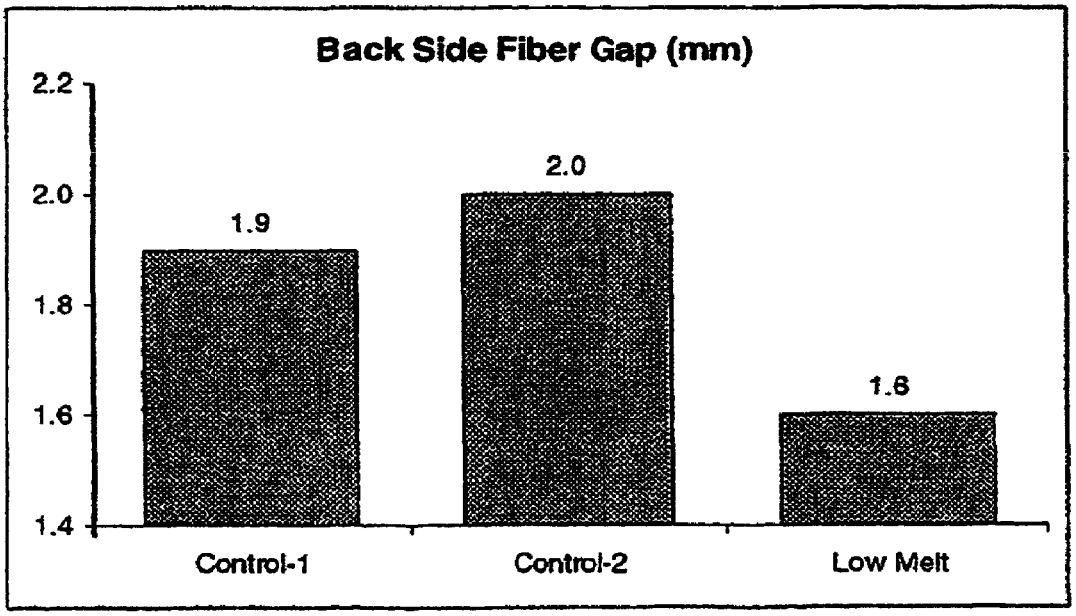
FIG. 5 is similar to FIG. 4 but including the size of the fiber gap at the machine side of the seam.

Permeability tests of the seam area of the fabric constructed in accordance with the present invention compared to that of two similarly constructed fabrics, controls 1 and 2, the only difference in construction being the non-insertion of low melt stuffer yarns, are shown in FIG. 4. The figure shows the percentage change in permeability (measured in cfm) in the seam region compared to the non-seam region of the fabric. Controls 1 and 2 demonstrated an increase in permeability of 5.4 and 5.8% respectively, compared to their non-seam regions, while the fabric incorporating low melt stuffer yarns in accordance with the invention, demonstrated a very small decrease in the permeability in its seam region, compared to its non-seam region. This demonstrates an improved homogeneity in the seam region, for the fabric constructed in accordance with the invention. Tests conducted on the same three fabrics to measure the amount of fiber lost during seam preparation demonstrated that 30% less batt fiber was lost in the seam region for the fabric constructed in accordance with the invention compared to that of controls 1 and 2, demonstrating an increased anchorage of the batt. It is known that batt fibers become detached from the backside (machine side) of the fabric in the area of the seam when the ends are separated. As a result of this, there is a small gap in the batt fiber coverage on the backside of the fabric over the seam after the loops have been interdigitated and held together with the installation pintle. Tests on the back side (machine side) fiber gap of the seam region for these fabrics are illustrated in FIG. 5, from which it is apparent that the fiber gap is smaller at the seam constructed with the low melt seam when compared to those of controls 1 and 2. Thereby use of low melt stuffer in the seam reduces the size of this gap.

The low melt stuffer yarn may be such that it fully melts or at least partially melts to encapsulate any fibers of the batt layer needled therein. While melting is described it is to be understood that this also covers the possibility that the stuffer simply deforms upon heating to bind the fibers and any adjacent yarns of the fabric seam. The stuffer yarn could be a monofilament yarn which may be in the form of a bi-component yarn in which the sheath forms a low melt component, while the core includes higher melt components. The stuffer yarn may also be in the form of a multi-filament yarn. Furthermore at least some of these filaments may be in the form of bi-component filaments with low melt sheaths. The stuffer yarn may be a spun yarn which includes at least some low melt fibers. Furthermore the low melt fibers may be in the form of a bi-component fiber which has a low melt sheath or a combination of low melt fibers and such bi-component fibers.

The invention is not restricted to the above described embodiment, and many modifications and variations can be made. For example, it is to be understood that although a batt layer has been described provided at just one side of the base layer, a similar batt layer could be connected to the opposite side of said base layer and the needled fibers thereof encapsulated as described above. The loops may be formed by weaving back into the fabric free warp yarns, or by helical seaming spirals which are bound into the fabric by a holding yarn. Although the provision of a low melt stuffer yarn has been described as being inserted in the interior space in the neck of the loop at either side of the pintle and then melted in order for its material to mold itself to that interior space to effectively fill the void, instead only one such space may be occupied by that yarn, or more than one yarn could be inserted into one or more of the spaces.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of manufacturing a fabric seam in a fabric for use as papermachine clothing, said method comprising the steps of:

providing that the fabric includes a plurality of loops at each transverse end of the fabric, said plurality of loops being adapted for interconnection using a pintle to make the fabric endless;

bringing said transverse ends into an end-to-end disposition in order to interdigitate said plurality of loops;

inserting said pintle in said interdigitated plurality of loops;

heat setting to fix a plurality of base yarns of the fabric and said plurality of loops of the fabric in place;

inserting at least one stuffer yarn, at least a part of which includes a low melt component, into selected void areas in said plurality of loops adjacent said pintle, a melting point of said low melt component being up to 140° C., wherein said stuffer yarn is distanced from said pintle by the interdigitated plurality of loops connected by said pintle;

adhering at least one batt layer to the fabric seam by needling; and heat setting to at least partially melt said at least one stuffer yarn such that said at least one stuffer yarn deforms to substantially take on a shape of said void areas at a pintle joint, to encapsulate and bind a plurality of fibers of said at least one batt layer needled into said void areas and to bind adjacent ones of said plurality of base yarns of the fabric.

2. The method according to claim 1, wherein said low melt component has a melting point which is less than that of the fabric.

3. The method according to claim 1, wherein one of (a) the fabric is woven and said plurality of loops are formed by back-weaving a plurality of free warp yarns, and (b) said plurality of loops are separate seaming spirals which are bound into the fabric by a holding yarn.

* * * * *